United States Patent [19]

Dyas

[11] 4,017,032

[45] Apr. 12, 1977

[54] FORMATION AND TRANSPORTATION OF SLURRIED UNCONSOLIDATED OVERBURDEN

[75] Inventor: Keith E. Dyas, Bagdad, Ariz.

[73] Assignee: Cyprus Mines Corporation, Los Angeles, Calif.

[22] Filed: Aug. 7, 1975

[21] Appl. No.: 602,575

[52] U.S. Cl. ..... 241/15; 241/46.11; 241/236

[51] Int. Cl.[2] ..... B02C 23/36

[58] Field of Search ..... 241/38, 43, 46 R, 46.02, 241/46.08, 62, 81, 88.4, 243, 15, 27, 30

[56] References Cited

UNITED STATES PATENTS

| | | | |
|---|---|---|---|
| 1,355,021 | 10/1920 | Waller | 241/243 |
| 2,132,165 | 10/1938 | Henry | 241/81 |
| 2,280,944 | 4/1942 | Foresman | 241/46 R |
| 2,602,379 | 7/1952 | Dodge | 241/46 R |

OTHER PUBLICATIONS

B462,828, Mar. 1976, Umphrey, 241/46.11.

*Primary Examiner*—Granville Y. Custer, Jr.
*Attorney, Agent, or Firm*—Woodcock Washburn Kurtz & Mackiewicz

[57] ABSTRACT

Improved apparatus for disintegrating and slurrying unconsolidated overburden for transport to a distant site. A hopper-like enclosure having a sloping floor is provided with a plurality of high-pressure water jets near the upper end thereof. The jets are directed tangentially along the floor surface. A first, coarse grillwork across the top of the hopper opening screens out large, consolidated material fragments and assists in disintegrating lumps of unconsolidated overburden. The overburden passes through the upper grillwork and falls upon the sluicing, high pressure water which mixes with the overburden and carries it downwardly toward an aperture in the hopper floor. A pair of toothed rollers are disposed in the aperture along with a second, finer, grillwork having bars extending between the roller teeth. Fine material passes readily through the fine grillwork, the larger chunks of overburden being comminuted by the rollers. The thus-formed slurry passses to a pump which forces it through a suitable channel to a distant impoundment area. In a preferred embodiment, clarified water is reclaimed from the impoundment area and recycled through the nozzles.

9 Claims, 3 Drawing Figures

FORMATION AND TRANSPORTATION OF SLURRIED UNCONSOLIDATED OVERBURDEN

BACKGROUND OF THE INVENTION

The present invention relates to means for disintegrating unconsolidated overburden, and more particularly to apparatus for comminuting and slurrying overburden, and transporting it to a remote site.

Certain types of valuable mineral deposits occur over a broad area, a short distance beneath the soil surface. Access to the minerals may be had by removing the overburden which overlies the minerals, a process known as stripping. When the overburden material is consolidated (e.g. rock or shale) it must be broken into discrete chunks and carried away. Procedures such as drilling and blasting are required to break up and to dislodge such consolidated overburden.

Where the overburden is unconsolidated (e.g. clay, sand, topsoil and the like) the removal operation is simpler. Shovels, draglines, tractors and loaders may be used to dislodge the overburden. The material is then dumped into trucks or other conveyances and transported to a depositing area for dumping. While this method is usually satisfactory it is relatively expensive in that a number of vehicles are required, and a great deal of fuel is consumed in the operation of the vehicles. Further, simply dumping the dislodged overburden creates vast areas of soft, loose material which requires subsequent compaction if a firm surface is desired. A still more serious problem is that the use of vehicles to transport the overburden causes stripping operations to be dependent upon the weather. Rains soften the ground surface making it impossible for the transport and digging vehicles to operate. In such cases, strippng operations must be suspended until the soil has dried sufficiently to allow the vehicles to be used.

The principle of transporting comminuted, slurried material has long been known. Practical applications of this procedure, however, have heretofore been confined to situations in which the material to be transported is of a predictable, uniform nature. Usually the material has taken the form of fine powdered or granular materials such as clinkers or ashes. For example, in U.S. Pat. No. 2,980,944 — Foresman a slurrying system is disposed beneath the stoker discharge of a furnace. The material discharged from the stoker falls into a chamber therebeneath where it is agitated and circulated by means of water jets. Most of the material is washed horizontally through a vertically-extending screen. Coarse particles which do not pass through the screen settle into an area above a pair of grinding rolls, which comminute them and pass them to a discharge pipe.

Similarly, in U.S. Pat. No. 1,818,967 — Allen a scheme for slurrying furnace discharge is shown in which a spray of water is directed upon ash which has been allowed to fall upon an inclined floor section. The exposed surface of the ash pile is washed away by the water, through a grate and into a discharge conduit.

These apparatus, however, are unsuitable for use with stripping operations wherein non-uniform, unconsolidated overburden is encountered. It has been found that apparatus of the type shown by Foresman may readily clog in such an environment, and does not produce the desired slurry. Apparatus like that taught by Allen is also not well adapted to receive and transport materials of varying sizes and characteristics. Accordingly, it will be understood that a long-standing need has existed for an improved apparatus for receiving, slurrying and transporting unconsolidated overburden.

It is therefore an object of the present invention to provide improved means for disintegrating materials to be slurried and transported.

It is another object of the invention to provide apparatus for disintegrating and slurrying unconsolidated overburden.

Still another object is to provide improved means for slurrying and transporting unconsolidated overburden to a remote site.

SUMMARY OF THE INVENTION

Briefly stated, in accordance with one aspect of the invention the foregoing objects are achieved by providing a hopper having an inclined floor and a plurality of high-pressure water jets near the upper end of said floor, directed downwardly thereacross. A first, coarse grillwork across the top of the hopper is provided to both prevent entry of inordinately large objects, and to break up lumps of impinging overburden. A second, finer grillwork is disposed in an opening adjacent the lower end of the inclined floor, and constitutes a plurality of horizontally-extending bars. A pair of rotating toothed rolls is also disposed across the aperture, the teeth of the rolls passing between the extending bars and cooperating therewith to further comminute and encourage slurrying of the impingement overburden. A pump receives the materials discharged through the second grillwork and forces it through a conduit to a remote impoundment area. In a preferred embodiment, clarified water is pumped from the impoundment area and recycled through the nozzles.

DESCRIPTION OF THE DRAWINGS

While the specification concludes with claims particularly pointing out and distinctly claiming the subject matter which is regarded as the invention, it is believed that the invention will be better understood from the following description of a preferred embodiment taken in conjunction with the accompanying drawings in which:

DESCRIPTION OF A PREFERRED EMBODIMENT

Figure 1:
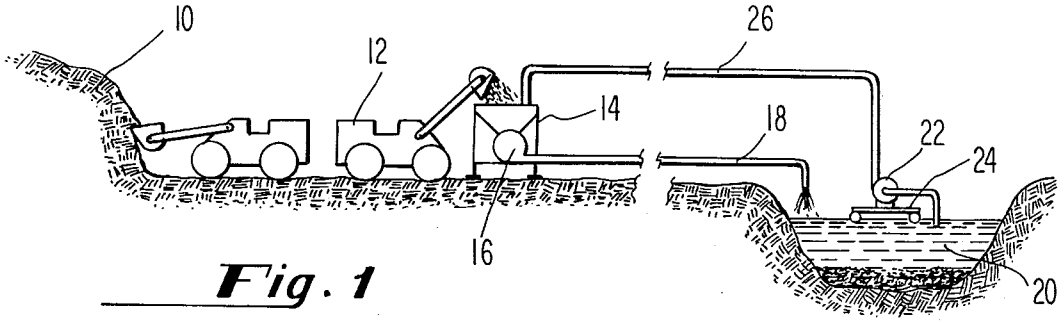
FIG. 1 is an idealized diagram showing the operation of a system using the teachings of the present invention.

Turning now to FIG. 1, there is represented in simplified form a stripping operation making use of the inventive apparatus. Unconsolidated overburden 10 is mechanically dislodged by suitable means, here depicted as a loader 12. The loader discharges the removed overburden onto the upper surface of the disintegrator 14. Due to the unique construction of the disintegrator, the overburden is progressively disintegrated and slurried. The slurry is then forcibly discharged by pump 16 and transported through a suitable conduit 18 to a distant impoundment area, generally designated 20. The slurried overburden is discharged at a desired spot in the impoundment area where the particulate matter settles and the supernatant discharge water becomes relatively clear. A pump 22 supported by float 24 acts to draw up the clarified water and force it through a return conduit 26. The returning, pressurized water is then fed through suitable chambers to encourage the movement and disintegration of overburden within disintegrator 14.

It will be appreciated that impoundment area 20 may be located at any desired point, which may be a considerable distance from the site of the stripping operation. It will be appreciated that if the distance is sufficient, or if considerable elevation of the slurried overburden is required, it may be necessary to add additional pumps along conduit 18. However, it can be seen that no vehicles are used for transporting the overburden, effecting a substantial saving in both time and fuel.

A still further advantage which inheres in the illustrated scheme relates to the compact nature of the overburden deposited at the impoundment area. The precipitated overburden, when dried, forms a hard, compact surface which has been found to support traffic soon after excess water is drained away. Thus, a strong environmental advantage accrues in that previously stripped areas can rapidly and economically be reclaimed with little or no need for additional grading or other mechanical operations.

With slight modification the system of FIG. 1 is adaptable for use under extremely wet, muddy conditions. In particular, the disintegrator 14 may be placed in a trench or hole below grade surface, and a dragline or bulldozer used to charge the disintegrator by drawing dislodged overburden directly across the ground surface and onto the disintegrator. When the loosened overburden reaches the depression in which the disintegrator is located, it is merely pushed into the depression so that it falls upon the disintegrator to be broken up and slurried. By eliminating the need for elevating the dislodged material before dropping it into the disintegrator, the need for wheeled vehicles such as loaders 12 is avoided and stripping operations can proceed under adverse weather conditions.

Figure 2:
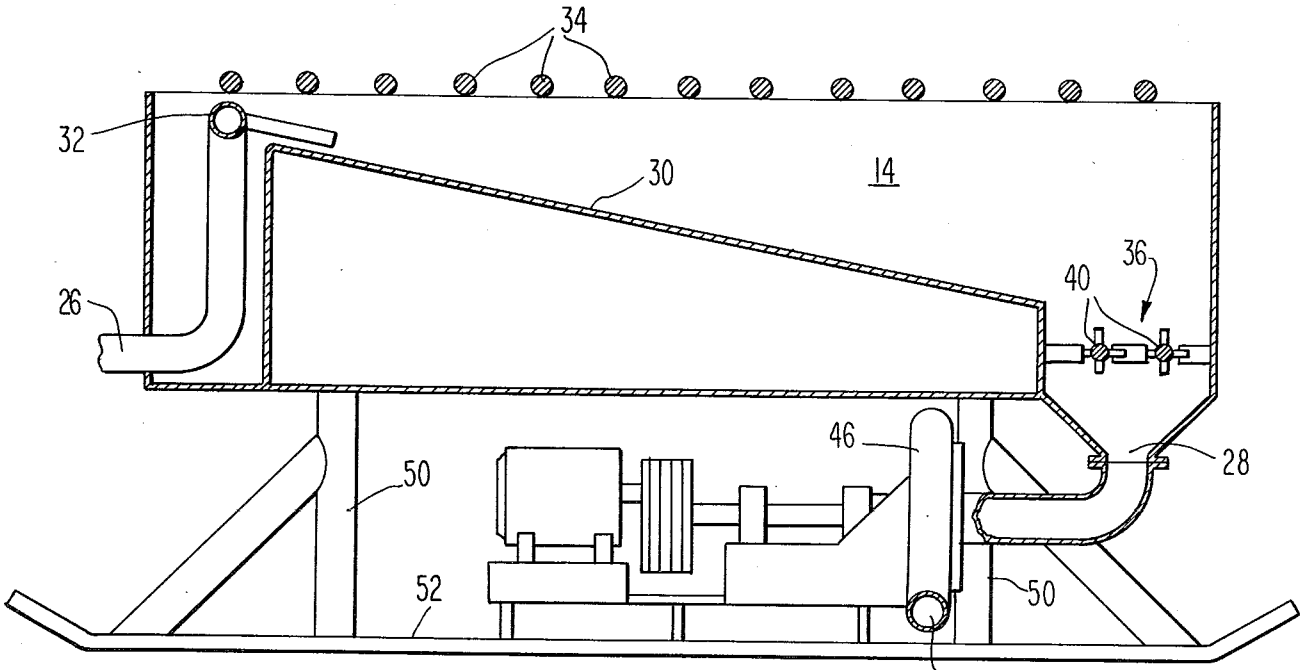
FIG. 2 is a sectioned view comprising a side elevation of the inventive apparatus.

FIG. 2 shows disintegrator 14 in cross section form. The body of the disintegrator forms a hopper having generally upright sidewalls and a discharge sump 28 at the lowest point thereof. The floor 30 of the hopper is inclined substantially from the horizontal, and near the upper end of the inclined floor high-pressure water nozzles 32 are affixed. The nozzles are oriented generally parallel with the surface of inclined floor 30 to progressively disintegrate incoming lumps of overburden and to aid in flushing overburden downwardly along the inclined floor.

Across the top of the hopper is disposed a first, coarse grillwork which is comprised of series of parallel steel bars 34. These bars serve a dual purpose. Firstly, they serve to prevent entry into the hopper of undesirably large pieces of overburden, rocks, and the like. Secondly, the bars serve as anvil surfaces against which the overburden forcibly impinges. The bars thus constitute an initial disintegrating stage, breaking chunks of overburden into smaller pieces which then fall between the bars and upon inclined surface 30 where they enter the path of the high-pressure water emanating from nozzles 32.

Adjacent the lowermost end of inclined floor 30 is an opening generally designated 36. Disposed in the aperture is a second, finer grillwork 38. Grillwork 38 is composed of a series of metal bars which are spaced more closely than bars 34. Finer segments of the wetted overburden thus pass directly through the fine grillwork and are discharged through outlet 28. The ends of the grillwork bars also extend horizontally to cooperate with toothed rollers 40 in a manner to be discussed hereinafter, for further comminuting larger segments of the wetted overburden.

A suitable pump 36 receives the slurried material discharged through outlet 28 and forces it through conduit 18 to a distant site. In a preferred embodiment a 6-inch pump was utilized, and driven by an electric motor. While many pumps are available and adaptable for the illustrated use, a slurry pump designated model SPN manufactured by the Dekor Company of Columbus, Ga. was utilized in one successfully-tested embodiment.

In order to elevate the hopper assembly adequately to raise the discharge outlet 28 above pump 46, a plurality of vertical supports 50 are provided. Further, the inventor has found that in order to support the apparatus upon the terrain encountered under typical stripping operations, and to facilitate the transport of the hopper assembly from one location to another, a pair of ski-like skids 52 are fastened to the lower ends of supports 50. Finally, a conduit 26 is coupled to nozzles 32 for receiving high-pressure water from a suitable source.

Figure 3:
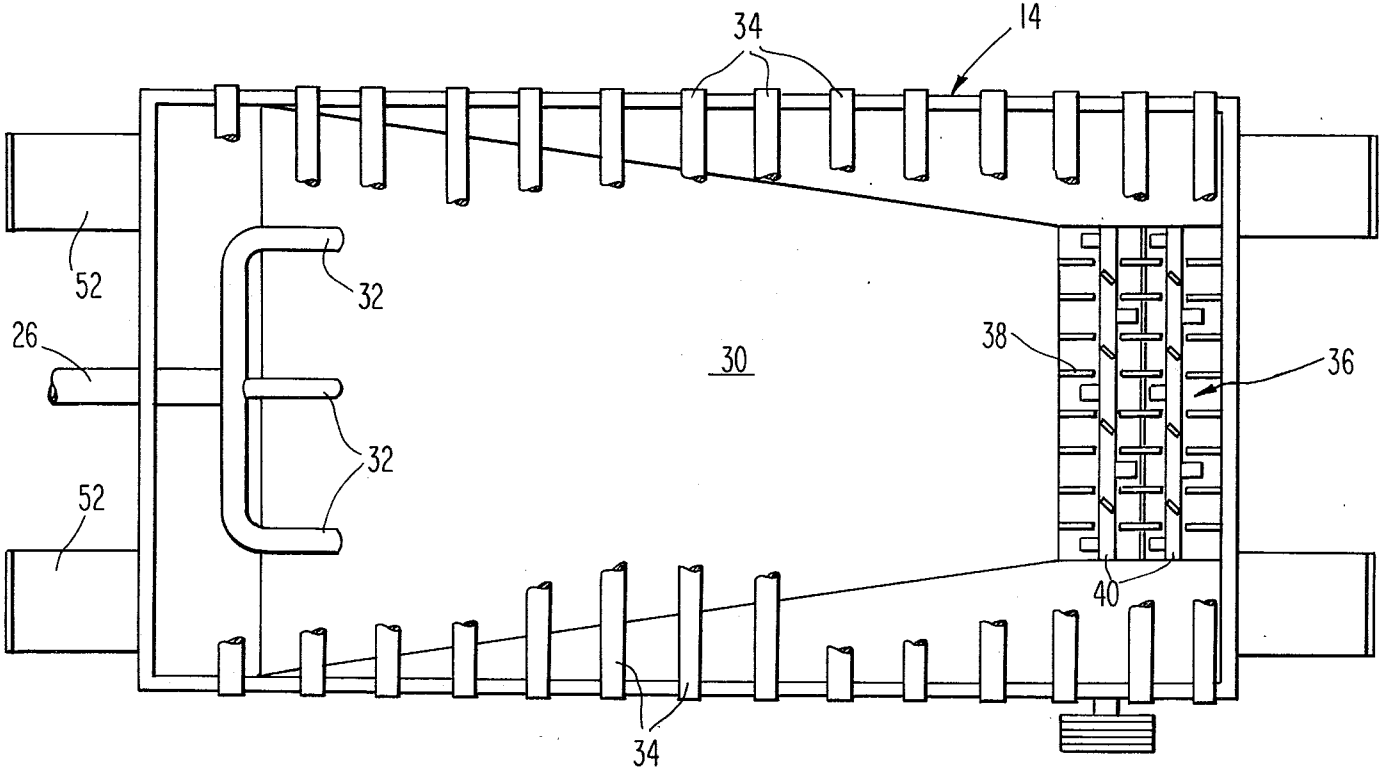
FIG. 3 is a top view of the apparatus shown in FIG. 2.

FIG. 3 shows a plan view of the hopper assembly showing the invention in further detail. The first, coarse grillwork is broken away to show the inclined floor 30, the toothed rolls 40 and the second, finer grillwork disposed in the opening about the toothed rolls and adjacent the lower end of the inclined floor.

It will be seen that the fine grillwork 38 comprises a series of horizontal flat metal bars turned edgewise and oriented to lie between the paths of the teeth of rolls 40. As the rolls turn, the teeth pass between the aligned bars to effect a disintegration of that portion of the wetted overburden which has not been washed through the fine grillwork. The roll teeth are advantageously oriented at an angle to the axis of the roll shaft to enhance their operation. In order to prevent damage to the rolls or to the teeth thereon, the rolls are coupled to an appropriate drive by means of shear pins. If segments of rock, large pieces of metal or the like lodge between the teeth and neighboring bars the pins will shear and prevent damage to the rolls or teeth.

It will now be appreciated that the upper, coarse grillwork, the nozzles and inclined floor, and the juxtaposed toothed rolls and fine grillwork all comprise integral elements of a disintegrating system which acts to place the received overburden in slurried form. Tests have shown the depicted configuration to be well adapted for slurrying the unconsolidated overburden commonly encountered in stripping operations and be highly resistant to clogging, a problem which has plagued prior art apparatus. It has been discovered that the coaction of the high-pressure water directed substantially in parallel with the surface of an inclined hopper floor has a highly beneficial effect upon disintegration of the impinging overburden. Further, the coaction of the second teeth of the second, finer grid and the toothed rolls provides a continuous cleaning action which prevents the unwanted build-up of solid matter at the bottom of the hopper. As will be evident from the foregoing description, certain aspects of the invention are not limited to the particular details of the examples illustrated, and it is therefore contemplated that other modifications or applications will occur to those skilled in the art. It is accordingly intended that the appended claims shall cover all such modifications and applications as do not depart from the true spirit and scope of the invention.

What is claimed as new and desired to be secured by Letters Patent of the United States is:

1. Apparatus for disintegrating and slurrying unconsolidated overburden for transport from a region of sub-surface exploitation to a depositing area, comprising:

a hopper having upstanding sidewalls and an inclined bottom surface, said hopper having an opening adjacent the lowermost portion of said bottom surface;

a first, heavier grillwork disposed across the top of said hopper, said first grillwork defining a plurality of apertures;

a plurality of rotatably driven toothed rollers horizontally disposed across said opening;

a second, finer grillwork disposed horizontally across said opening about said rollers, said second grillwork defining a plurality of apertures smaller than the apertures defined by said first grillwork, said second grillwork comprising a plurality of members extending horizontally between the paths of the teeth of said rollers; and a plurality of nozzles disposed adjacent the upper edge of said bottom surface of said hopper and oriented generally parallel to said bottom surface to direct a high pressure stream of water directly upon unslurried overburden to break up said overburden and urge it onto said second grillwork.

2. The apparatus defined in claim 1, wherein sid first grillwork comprises a plurality of substantially parallel metal bars.

3. The apparatus defined in claim 2, further including pumping means for supplying pressurized water to said nozzles.

4. The apparatus defined in claim 3, further including second pumping means for receiving slurried overburden from said opening and urging it through a conduit.

5. Apparatus for transferring unconsolidated overburden from a region of subsurface exploitation to a depositing area, comprising:

a hopper having upstanding sidewalls defining a first opening for receiving dislodged overburden, an inclined bottom surface, and a second opening adjacent the lowermost end of said inclined bottom surface;

a first plurality of generally parallel bars extending across said opening, said bars being spaced apart by a first distance to allow unconsolidated overburden to pass therethrough;

a plurality of nozzles affixed to said hopper for directing streams of water upon unconsolidated overburden disposed on said inclined bottom surface to disintegrate and slurry said overburden and to urge said overburden toward said second opening;

a pair of toothed rollers rotatably supported adjacent said aperture;

a second plurality of generally parallel bars extending between the paths of the teeth of said rollers, said last-named bars being spaced apart by a second distance less than said first distance, for effecting further disintegration of the overburden;

a conduit extending from said hopper to the depositing area;

a first pump coupled to a portion of said hopper beneath said toothed rollers and second parallel bars for receiving slurried overburden therefrom and urging said overburden through said conduit to a depositing area wherein said overburden precipitates from said water;

a second pump disposed adjacent said depositing area for receiving clarified water therefrom; and a second conduit extending from said second pump to said nozzles.

6. The apparatus defined in claim 5, further including float means for supporting said second pump on the clarified water at said depositing area.

7. The apparatus defined in claim 6, wherein said toothed rolls extend substantially perpendicular to the direction of flow of the slurried overburden along said inclined floor surface.

8. The apparatus defined in claim 7, wherein said second plurality of bars are disposed in a generally horizontal plane with said aperture.

9. The method of disintegrating and slurrying unconsolidated overburden for transport from a region of sub-surface exploitation to a depositing area, comprising the steps of:

a. providing a hopper having upstanding sidewalls, an inclined bottom surface, and an opening adjacent the lowermost portion of the bottom surface;

b. providing a first, coarse grillwork across the top of the hopper;

c. providing a plurality of rotatable toothed rollers in said opening;

d. providing a second, fine grillwork in said opening, said grillwork comprising a plurality of horizontal members extending between the paths of the teeth of the rollers;

e. discharging overburden through said first grillwork and onto said inclined bottom surface;

f. directing a stream of pressurized water directly upon the unslurried overburden to disintegrate the overburden and to urge the disintegrated overburden downwardly along the bottom surface to the second grillwork; and g. rotating said toothed rollers between the horizontal members of the second grillwork to comminute the overburden urged thereupon.

* * * * *